US008037804B1

(12) United States Patent
Wahlquist

(10) Patent No.: US 8,037,804 B1
(45) Date of Patent: Oct. 18, 2011

(54) DYNAMIC ARMOR

(75) Inventor: Gary F. Wahlquist, McKinney, TX (US)

(73) Assignee: Raytheon Company, Waltham, MA (US)

( * ) Notice: Subject to any disclaimer, the term of this patent is extended or adjusted under 35 U.S.C. 154(b) by 1014 days.

(21) Appl. No.: 11/867,943

(22) Filed: Oct. 5, 2007

Related U.S. Application Data

(60) Provisional application No. 60/828,445, filed on Oct. 6, 2006.

(51) Int. Cl.
*F41H 5/02* (2006.01)

(52) U.S. Cl. ..... 89/36.02; 89/36.07; 89/36.08; 89/36.09; 89/904; 89/917; 428/911; 109/49.5

(58) Field of Classification Search ..... 89/36.01, 89/36.02, 36.04, 36.07–36.09, 36.17; 428/911; 109/49.5
See application file for complete search history.

(56) References Cited

U.S. PATENT DOCUMENTS 3,633,520 A * 1/1972 Stiglich, Jr. ..... 109/82
4,355,562 A * 10/1982 Sewell et al. ..... 89/36.02
4,404,889 A * 9/1983 Miguel ..... 89/36.02
4,426,429 A * 1/1984 Di Russo et al. ..... 428/654
4,969,386 A * 11/1990 Sandstrom et al. ..... 89/36.02
5,045,371 A * 9/1991 Calkins ..... 428/49
5,200,256 A * 4/1993 Dunbar ..... 428/212
5,317,950 A * 6/1994 Binon et al. ..... 89/36.02
5,637,824 A * 6/1997 Benyami ..... 89/36.17
5,866,839 A * 2/1999 Ohayon ..... 89/36.08
6,474,213 B1 * 11/2002 Walker et al. ..... 89/36.17
6,532,857 B1 * 3/2003 Shih et al. ..... 89/36.02
6,679,157 B2 * 1/2004 Chu et al. ..... 89/36.02
6,880,445 B2 * 4/2005 Benyami et al. ..... 89/36.17
6,895,851 B1 * 5/2005 Adams et al. ..... 89/36.02
6,955,112 B1 * 10/2005 Adams et al. ..... 89/36.02
7,225,717 B2 * 6/2007 Williams ..... 89/36.08
7,300,893 B2 * 11/2007 Barsoum et al. ..... 442/134
7,540,228 B1 * 6/2009 Cronin et al. ..... 89/36.02
7,540,229 B2 * 6/2009 Seo et al. ..... 89/36.17
7,617,757 B2 * 11/2009 Dickson ..... 89/36.02
7,818,820 B2 * 10/2010 Tsujimoto ..... 2/310
2004/0118271 A1 * 6/2004 Puckett et al. ..... 89/36.02
2004/0159228 A1 * 8/2004 Budnik ..... 89/36.02
2008/0307553 A1 * 12/2008 Jbeili et al. ..... 2/2.5
2009/0114083 A1 * 5/2009 Moore et al. ..... 89/36.02
2009/0217813 A1 * 9/2009 Carberry et al. ..... 89/36.02

* cited by examiner

*Primary Examiner* — Michael David
(74) *Attorney, Agent, or Firm* — The Noblitt Group, PLLC

(57) ABSTRACT

Methods and apparatus for ballistic shielding and protective armor; and more particularly, representative and exemplary embodiments of the present invention generally relate to improved methods and systems for ballistic deflection and protection through dynamic armor and/or the like.

17 Claims, 7 Drawing Sheets

DYNAMIC ARMOR

RELATED APPLICATIONS

This application claims the benefit of United States Provisional Patent Application Ser. No. 60/828,445 filed in the United States Patent and Trademark Office on Oct. 6, 2006.

BACKGROUND OF INVENTION

As weapons technologies have advanced, so too have the implements used for protection. Various materials have been employed as material technology has moved forward. The cost and weight of these various armoring materials and techniques are generally factors for designers. Additionally, historical armor materials and techniques generally require continuous updating to meet the demands of modern armaments. For instance, while steel has been used in traditional armor applications, it is generally impractical to employ steel in the dimensions needed to completely protect against all projectiles, as any vehicle carrying such armor would be severely hampered due to the excessive weight. Armor and shielding that is undersized or under-strengthened for its purpose is largely useless. In some cases, this scenario may give a false sense of security to the user.

Armor generally must be designed to protect against a wide variety of threats. The angle of attack, the method of threat, munitions used, and the frequency of danger are all factors that designers may consider.

While some armor is able to withstand the force and penetration of a single strike in a particular region, multiple strikes in the same zone generally represent an unprotected threat. Some armors employ explosive charges and "smart armor" techniques that engage an anticipated projectile, however these techniques severely limit the multiple strike capabilities in the same zone. Accordingly, there exists a need to address these and other deficiencies associated with conventional armor techniques.

SUMMARY OF THE INVENTION

In general, methods and devices for protective armor are disclosed; and more particularly, representative and exemplary embodiments of the present invention generally relate to improved methods and systems for ballistic deflection and protection through dynamic armor, and/or the like.

BRIEF DESCRIPTION OF THE DRAWINGS

Representative elements, operational features, applications and/or advantages of the present invention reside in the details of construction and operation as more fully hereafter depicted, described or otherwise identified—reference being made to the accompanying drawings, images, figures, etc. forming a part hereof, wherein like numerals (if any) refer to like parts throughout. Other elements, operational features, applications and/or advantages may be implemented in light of certain exemplary embodiments recited, wherein.

Figure 1:
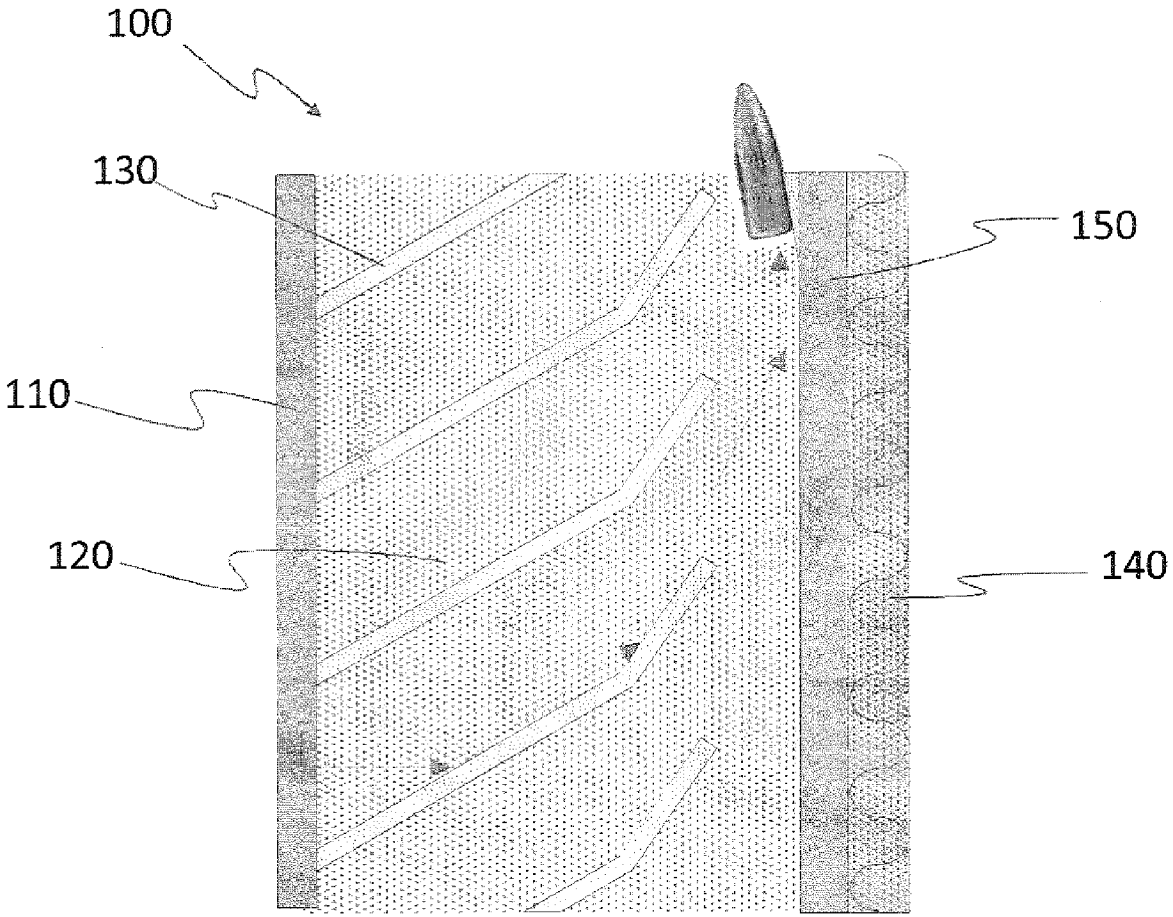
FIG. 1 representatively illustrates a dynamic armor system having embedded shaped bodies in the absorbing filler layer in accordance with an exemplary embodiment of the present invention.

Elements in the figures, drawings, images, etc. are illustrated for simplicity and clarity and have not necessarily been drawn to scale. For example, the dimensions of some of the elements in the figures may be exaggerated relative to other elements to help improve understanding of various embodiments of the present invention. Furthermore, the terms 'first', 'second', and the like, are used for distinguishing between similar elements and not necessarily for describing a sequential or chronological order. Moreover, the terms 'front', 'back', 'top', 'bottom', 'over', 'under', and the like in the disclosure and/or in the claims, are generally employed for descriptive purposes and not necessarily for comprehensively describing exclusive relative position. Any of the preceding terms so used may be interchanged under appropriate circumstances such that various embodiments of the invention, for example, may be capable of operation in other configurations and/or orientations than those explicitly illustrated or otherwise described.

DETAILED DESCRIPTION OF EXEMPLARY EMBODIMENTS

The following description is intended to provide convenient illustrations for implementing various embodiments of the invention. As will become apparent, changes may be made in the function and/or arrangement of any of the elements described in the disclosed exemplary embodiments without departing from the spirit and scope of the invention.

The present invention may be described herein in terms of conventional armor, strike plates, energy and/or shock absorbing materials and composite layers. It should be appreciated that the armor may comprise any number of conventional materials including, but not limited to ceramics, metals, plastics, fiberglass, glass, electrified materials, surface launchers, imbedded explosives, various other inorganic and organic materials, and/or the like. Furthermore, such armor may comprise various forms, layers, sizes, thicknesses, textures and dimensions. Additionally, the armor may be employed in civilian applications to protect vehicles and passengers in hazardous situations or in space travel, body armor, door and wall structures, maritime and aerospace applications, industrial applications, untamed areas, and/or the like. The armor may be adapted as a generic protective external surface.

The specification and Figures are to be regarded in an illustrative manner, rather than a restrictive one, and all such modifications are intended to be included within the scope of the present invention. Accordingly, the scope of the invention should be determined by the claims and their legal equivalents. For example, the steps recited in any method or process embodiments may be executed in any order and are not limited to the specific order presented in the claims. Additionally, the components and/or elements recited in any apparatus embodiment may be assembled, or otherwise operationally configured, in a variety of permutations to produce substantially the same result as the present invention and are accordingly not limited to the specific configuration recited in the claims.

Referring to FIG. 1, a system for dynamic armor 100 generally comprises a first surface layer 110, an absorbing filler layer 120 and a force absorbing material 140 (e.g., a kinetic layer). These layers may be integrated into unitary material or may comprise a plurality of divisional layers. Additionally, these layers may be assembled in various orders with or without duplication between layering.

First surface layer 110 may comprise the external surface of dynamic armor 100. This surface may be the face of the absorbing filler layer 120 or it may comprise a layer of additional material. First surface layer 110 may be fabricated from any suitable material. For instance, first surface layer 110 may be constructed of composite, steel, steel-composite, ceramic-composite, inorganic composite nanostructures, and/or the like. First surface layer 110 may be suitably configured for any thickness. This material may be similar or dissimilar to other materials used in the dynamic armor 100 system. Similarly, first surface layer 110, in accordance with a representative embodiment of the present invention, may be implemented to form various shapes or geometries, including but not limited to: squares, rectangles, triangles, cones, ovoids, prolate, and/or oblate spheroids, and/or the like. Further, first surface layer 110 may be segmented into various geometric planes and/or faces, such as, for example: quadrilateral, hexagonal, pentagonal, octagonal, and/or the like. These segments may extrude or extend from any angle with respect to first surface layer 110, and/or be at least partially integrated into the form of first surface layer 110. First surface layer 110 may have suitable coatings applied to it for camouflage or other practical reasons.

First surface layer 110 may reduce the velocity and force of projectiles striking the dynamic armor system 100. It will be appreciated that first surface layer 110 and/or protection materials, as shaped, may form angular deflection implements to redirect projectile trajectories. Additionally, the armor may be shaped or otherwise formed with a curvature to reduce ballistic damage, deflect material, protect against debris, weather, and/or the like. First surface area 110 may comprise multiple materials such as tile products for mosaic armor construction, a panel system, a layering scheme, plates with compound curvature, and/or the like. First surface layer 110 may be coupled to the absorbing filler layer 120. Additionally, first surface layer 110 may comprise a suitable shape to couple to the surface or objects it is designed to protect, for example, approximating the natural contours of the body in the case of body armor.

Figure 4:
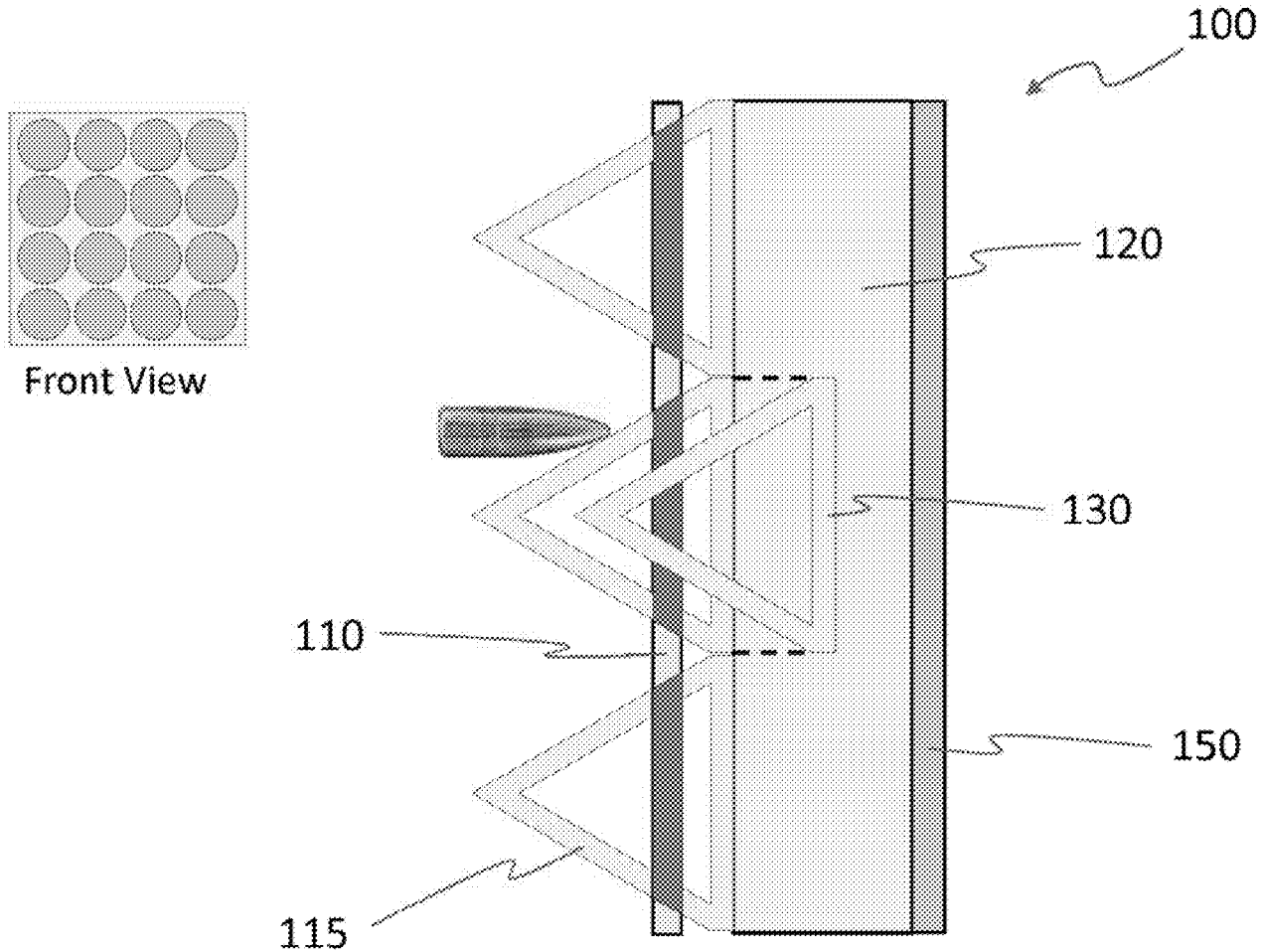
FIG. 4 representatively illustrates a dynamic armor system having shaped segmented dynamic zones in accordance with an exemplary embodiment of the present invention.

In a representative embodiment, referring to FIG. 4, first surface layer 110 may increase the area that comprises a high degree obliquity, axial inclination and/or the like to decrease ballistic damage and/or deflect shots, debris and/or the like. In one representative embodiment of the present invention, first surface layer 110 may comprise a strike plate 115 for reducing the velocity of a projectile. The strike plate 115 may be formed from any suitable material and/or comprise any suitable dimension. Strike plate 115 may be fashioned in any suitable orientation and/or suitable configuration or shape. Strike plate 115 may be configured to be static or dynamic.

Figure 5B:
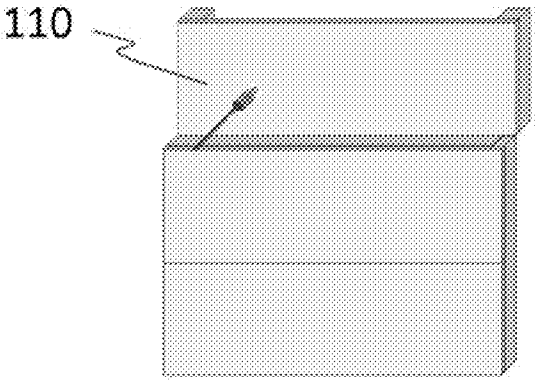
FIGS. 5B and 5C representatively illustrate dynamic armor systems having three (3) segmented and six (6) segments dynamic zones respectively in accordance with an exemplary embodiment of the present invention.
Figure 5C:
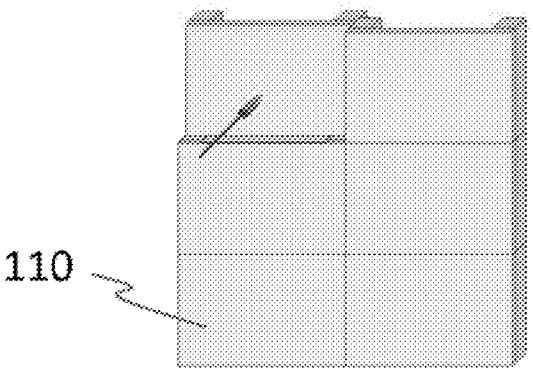
Figure 5A:
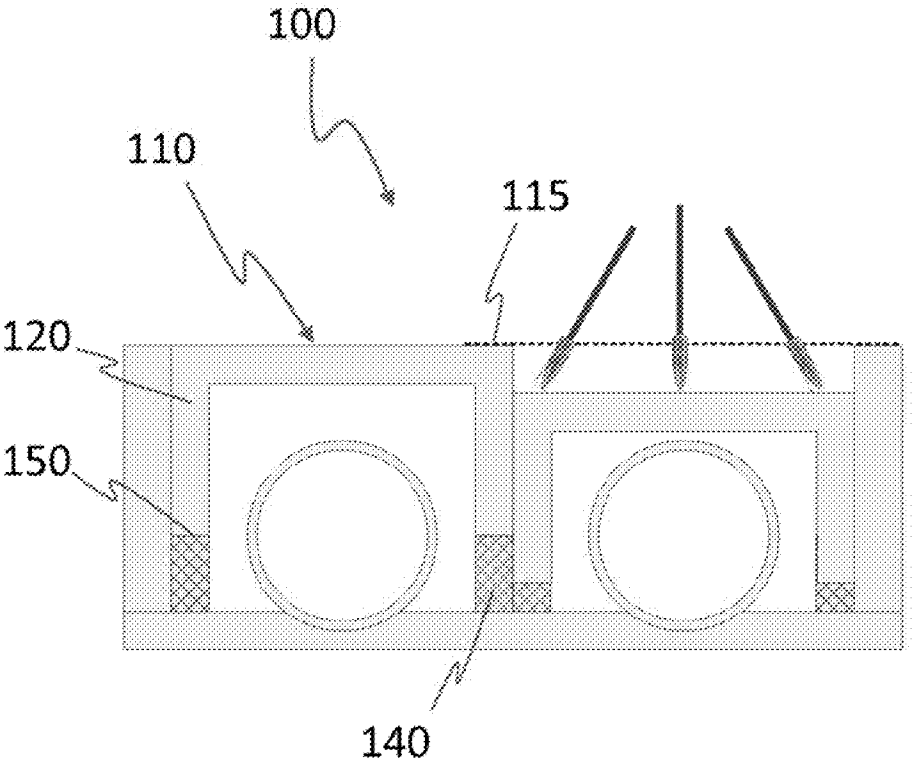
FIG. 5A representatively illustrates a dynamic armor system having segmented dynamic zones in accordance with an exemplary embodiment of the present invention.

In an alternative embodiment, referring now to FIGS. 5A-5C, first surface layer 110 comprises at least one segment of the dynamic armor system 100 which is configured to move in response to impact with a projectile or shock wave. Such an embodiment may incorporate a strike plate 115 that may be configured to present a planar surface to an impacting projectile, or may be shaped to present an angle of obliquity for an impacting projectile.

Absorbing filler layer 120 may comprise any space between the first surface layer 110 and the force absorbing material 140. This space may constitute an air gap or may be tilled with material. Absorbing filler layer 120 may comprise any conventional energy and/or shock absorbing materials, whether now known or hereafter described in the art. Such materials may comprise foams, springs, elastic materials, foam barriers, plastics, composite materials, plastics, protection barriers, and/or the like. Absorbing filler layer 120 may be coupled to the force absorbing material 140.

In one representative embodiment, absorbing filler layer 120 may comprise energy and/or shock absorbing materials placed in between first surface layer 110 and force absorbing material 140 to form dynamic armor. In another representative embodiment, referring now to FIG. 2, absorbing filler layer 120 may comprise a plurality of materials. This may include a segment of dynamic material coupled to first surface layer 110, and coupled to an energy absorbing material configured to move when impacted by a projectile. This dynamic material may comprise deflection material 130. The shape and orientation of this dynamic material may be such that it directs the forces and/or paths of the projectile away from the surface the armor is protecting. Force may be dissipated through at least one of the friction of the dynamic material moving upon impact, the shape and positioning of the dynamic material within the absorbing filler layer 120, and the compression of the force absorbing material 140 by the dynamic material.

Figures 3A, 3B:
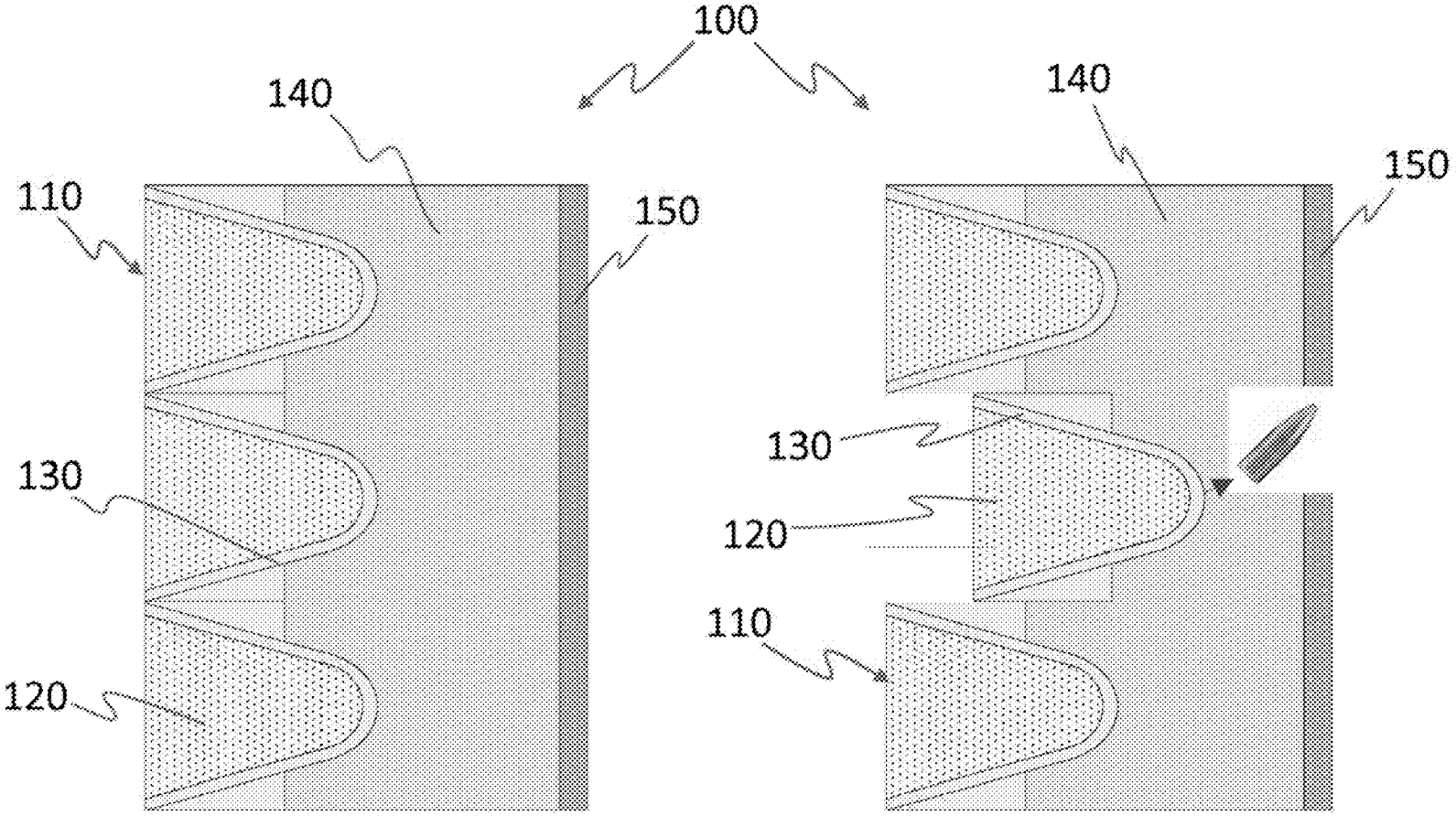
FIGS. 3A and 3B representatively illustrate dynamic armor systems having segmented dynamic zones before and during a projectile strike in accordance with an exemplary embodiment of the present invention.

In another representative embodiment, referring to FIGS. 3A and 3B, the absorbing filler layer 120 may be dynamic, wherein the armor is at least partially configured to move and/or recoil upon impact and/or the like. In the case of a dynamic filler layer 120, the layer may be configured such that it will be able to deform and reform upon impact. This recoiling will facilitate absorbing the force of multiple strikes within the same segment of armor. Sections of the first surface layer 110 may be configured to move against the absorbing filler layer 120 upon projectile strike.

In another embodiment of the present invention, the absorbing filler layer 120 may also comprise embedded shaped bodies 130 for redirection and fragmentation of the projectile. These obliquities may employ oblique strike angles to aid in redirection of the projectile and projectile elements.

Back strike plate 150 may comprise the forward facing plane of the force absorbing material 140 from the perspective of an impacting projectile, or it may comprise an additional layer of material. Back strike plate 150 may be configured to absorb the impact of a projectile. The back strike plate may also be configured to contain the various other layers of the dynamic armor 100 into their respective zones. Back strike plate 150 may act as a spall layer and may be fabricated from any suitable material. Back strike plate 150 may comprise the same material as the strike plate 115 or may be formed from a different suitable material. Back strike plate 150 may be any suitable dimension. Back strike plate 150 may be a dynamic force absorbing material or it may be static.

Back strike plate 150 may be configured for catching and/or deflecting projectiles, debris, fragments, and/or the like. Additionally, back strike plate 150, may comprise a suitable shape to couple to the material or objects it is designed to protect. For example, back strike plate 150 may be shaped to approximate the natural contours of the body in the case of body armor.

It should be appreciated that the energy and/or force absorbing material 140 may comprise any conventional energy and/or force absorbing materials, whether now known or hereafter described in the art. Such materials may comprise foams, foam barriers, plastics, composite materials, protection barriers, and/or the like. These materials may be implemented, according to various aspects of the present invention, to conform to any suitable size, shape weight, texture, form, thickness, density, and/or the like.

In a representative embodiment of the present invention, the energy and/or force absorbing material 140 may be at least partially configured to comprise a layer between the first surface layer 110 and the absorbing filler layer 120. In another representative embodiment of the present invention, referring to FIG. 6, the energy and/or force absorbing material 140 may be at least partially configured to absorb at the perimeter of strike plates 115, (150) and/or spall layer.

Though the dynamic armor 100 may comprise the external surface of the materials it is designed to protect, the dynamic armor 100 may, in the alternative, be mounted to a second surface. It will be appreciated that representative attachment mechanisms in accordance with representative aspects of the present invention may comprise any conventional mounting devices, such as, for example: rings, frames, plates, bases, screws, nuts, bolts, nails, adhesives, welds, couplers, and/or the like. Additionally, the attachment means of the present invention may comprise any conventional materials, such as ceramics, metals, plastics, composites, fiberglass, various other inorganic and organic materials and/or the like. The parameters of the attachment mechanism, such as, for example: size, shape, form, texture, dimensions, integrity, and/or the like, may comprise any suitable parameters that may be suitably adapted to provide attachment mechanisms in accordance with representative aspects of the present invention.

It will further be appreciated that the mounting devices may be attached to, affixed to, and/or coupled to the protection and armoring materials to substantially form protection and armor devices. In a representative embodiment, the attachment means may comprise welding the dynamic armor 100 to a second surface.

Figure 7:
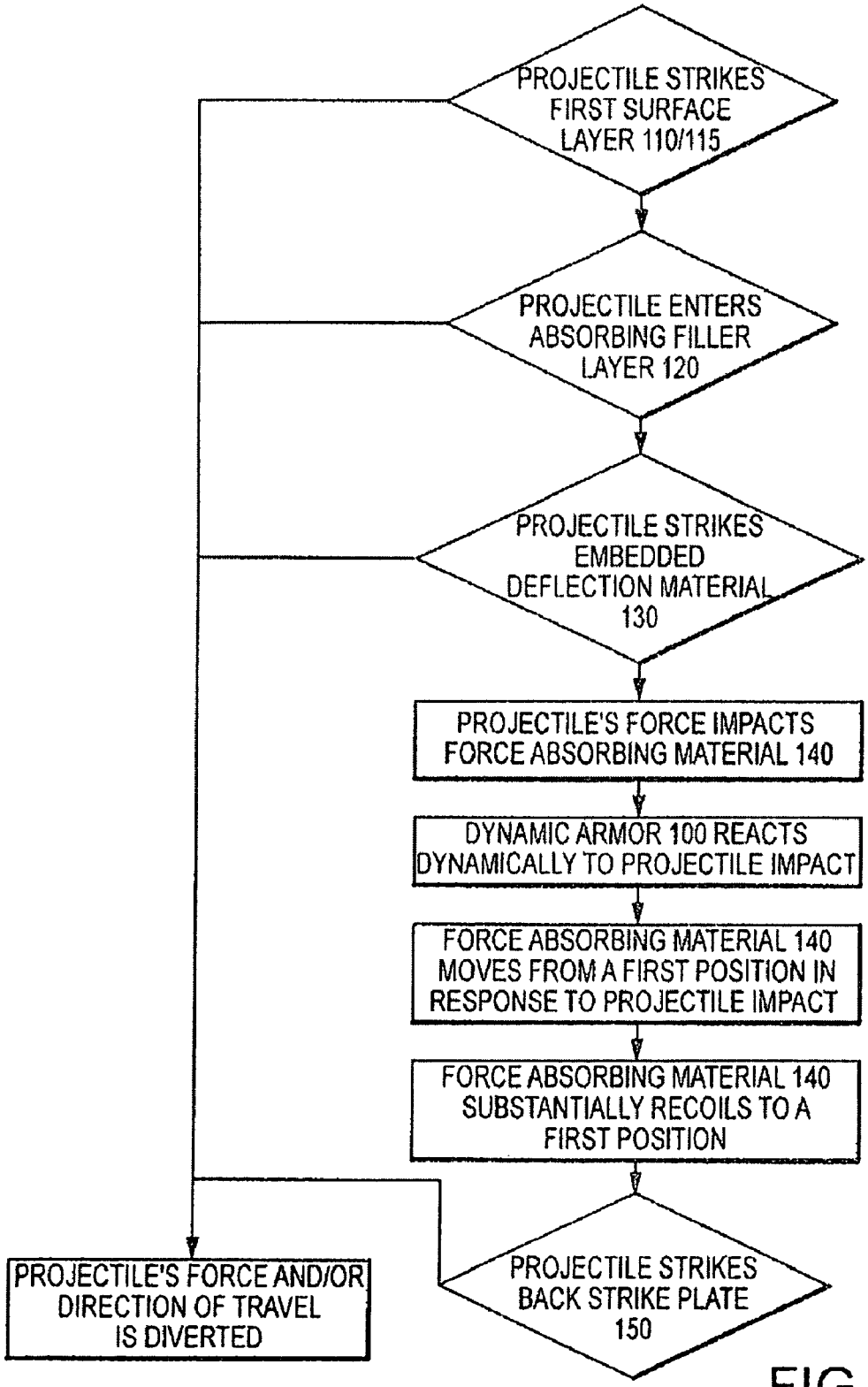
FIG. 7 representatively depicts a flow diagram of a dynamic armor system in accordance with an exemplary embodiment of the present invention.

Referring to FIG. 7, the dynamic armor 100 may be mounted on or comprises the outer surface of the material to be protected. In another embodiment, the first surface layer 110 may be oriented to the exterior of the dynamic armor 100. This generally comprises the first surface with which a projectile striking the dynamic armor 100 will come in contact. In a representative aspect, the first surface may comprise a strike plate 115 configured to reduce the projectile velocity upon impact. Next, the projectile may be further slowed and its trajectory altered by the energy absorbing filler layer 120. The projectile may cause a section of the armor to react dynamically to the projectile's impact and cause the force absorbing material 140 to absorb force. Upon impact, the force absorbing material 140 may be configured to flex from a first position dynamically when impacted by a blast, projectile, or projectile fragment. This material may be configured to recoil substantially to a first position after a projectile impact. If the projectile has enough velocity, the projectile will ultimately strike the back strike plate 150.

Figure 2:
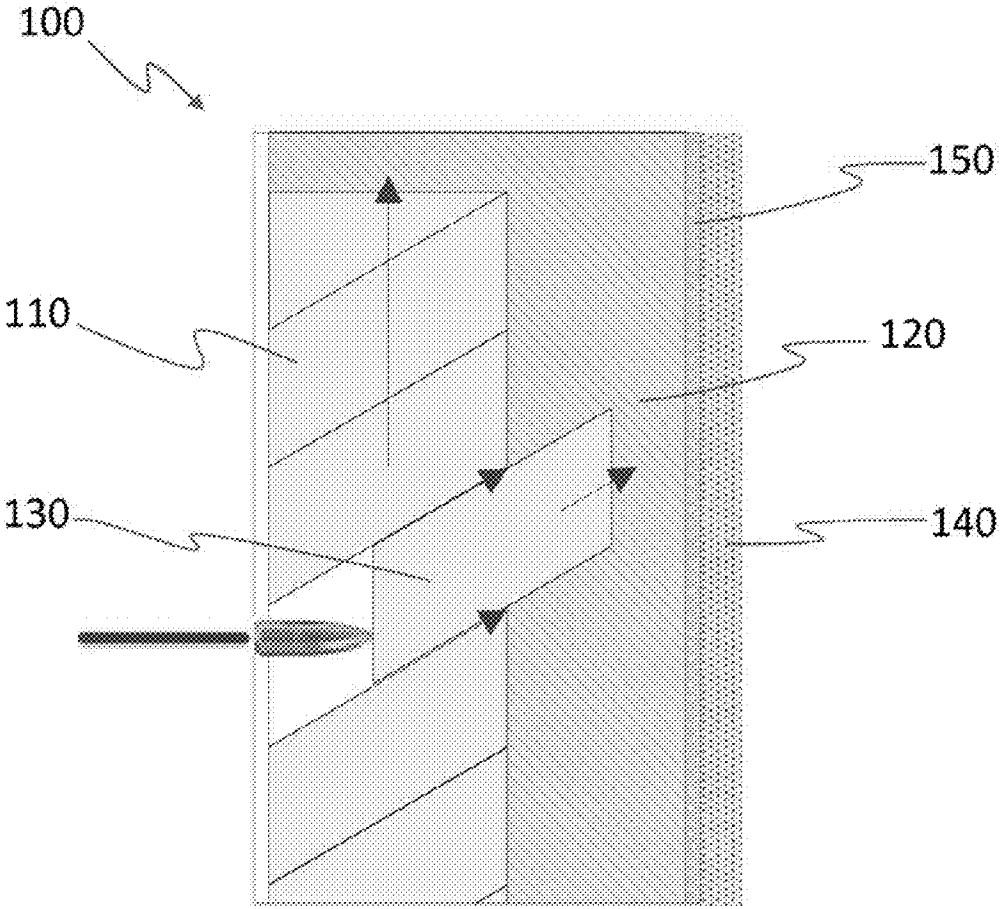
FIG. 2 representatively illustrates a dynamic armor system having dynamic materials located in the absorbing filler layer in accordance with an exemplary embodiment of the present invention.

In another representative embodiment, referring to FIG. 2, deflection materials 130 may be located such that a projectile may make contact with them should the projectiles penetrate through the first surface layer 110. These deflection materials 130 or embedded shaped bodies may redirect the force and/or direction of the projectile away from the surface or materials the armor is protecting. This generally results in force being dissipated and directed away from the protected surface. Post projectile impact, the absorbing filler layer 120 and/or force absorbing material 140 will reform relocating the deflection materials 130 substantially back to their original locations.

In yet another embodiment, referring to FIGS. 3A and 3B, the first surface layer 110 may comprise the forward facing plane of the absorbing filler layer 120. These segmented protective elements generally react dynamically to projectile impacts. Upon impact, the projectile is slowed by impacting the absorbing filler layer 120, which then makes contact with deflection material 130 that deflects the projectile and segments the absorbing filler layer 120. The force absorbing material 140 may be coupled to the absorbing filler layer 120 and compresses due to the force of the segmented absorbing filler layer 120 during impact. The slowed and/or deflected projectile will then be further directed away from the protected surface by the force absorbing material 140. In the present embodiment, the back strike plate 150 may comprise a spall layer to contain the diverted projectile. The compressed force absorbing material 140 generally reforms and directs the deformed absorbing force layer 120 substantially back to its original pre-impact conformation.

En yet another embodiment, referring to FIG. 4, the first surface layer 110 may be shaped such that it presents an oblique angle for impacting projectiles. First surface layer 110 may also comprises deflection material 130. The shape generally helps to redirect and/or dissipate the force of an impacting projectile. The first surface layer 110 may be segmented and compressed upon projectile strike. The absorbing filler layer 120 generally dissipates the force of the impact. Back strike plate 150 serves to contain projectile elements if needed.

In yet a further embodiment, referring now to FIG. 5A thru 5C, the first surface layer 110 may be compartmentalized into segmented faces. These faces may be built around the surfaces they are configured to protect, as shown, or they may be fabricated over the surface they are designed to protect. These segmented faces individually compress against the force absorbing material 140 upon projectile impact. Additionally, the absorbing filler layer 120 compresses to dissipate the force of the impact. The movement of the segment helps to dissipate and redirect the force of the impact. Post projectile impact, the segment reforms to substantially its original conformation.

Figure 6:
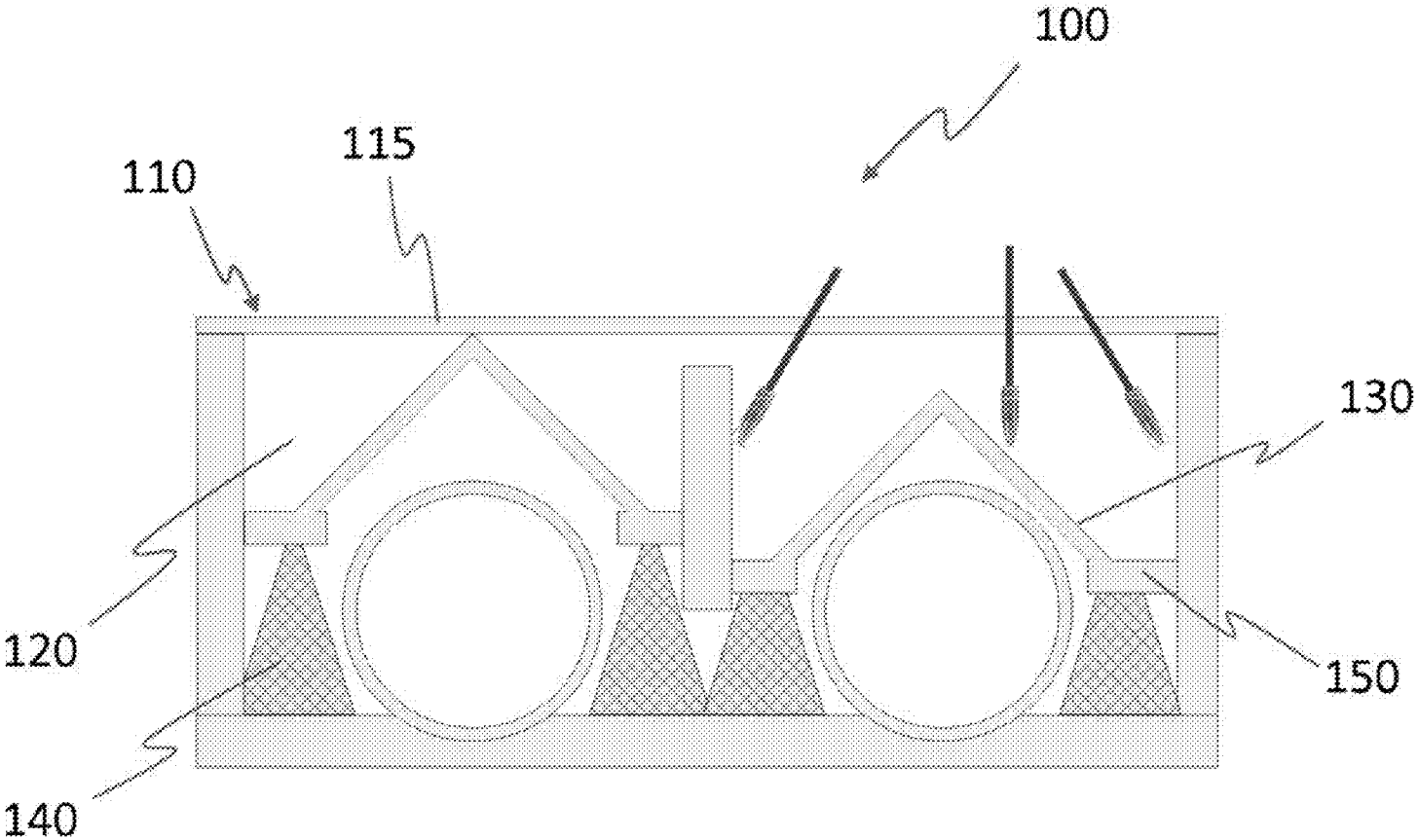
FIG. 6 representatively illustrates a dynamic armor system having embedded segmented dynamic zones in accordance with an exemplary embodiment of the present invention.

In yet another representative embodiment, referring now to FIG. 6, the dynamic armor 100 system may comprise a first surface layer 110 coupled to an absorbing filler layer 120. Coupled to this, absorbing filler layer 120 may be a shaped deflection material 130. These shaped deflection materials 130 generally serve to both dissipate force and redirect the trajectories of projectiles. The deflection materials 130 may be coupled to force absorbing material 140 that deform during projectile impact. This deformation redirects the force of the projectile away from the surfaces that the dynamic armor 100 is designed to protect. Post projectile impact, the deflection material 130 generally reforms to substantially its original conformation.

The dynamic armor 100 may comprise dynamic elements, functions, and/or features. Among other qualities, this generally allows the armor to move and recoil on impact. By decelerating the projectile over a longer stopping distance, the impact force may be reduced with energy absorbed and/or dissipated over a larger area.

The particular implementations shown and described are illustrative of the invention and its best mode and are not intended to otherwise limit the scope of the present invention in any way. For the sake of brevity, conventional manufacturing, connection, preparation, and other functional aspects of the system may not be described in detail. The connecting lines shown in the various figures are intended to represent exemplary functional relationships and/or physical couplings between the various elements. Many alternative or additional functional relationships or physical connections may be present in a practical system.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

I claim:

1. A dynamic armor system, comprising:

a first surface layer for absorbing impact;

a second layer comprising an absorbing filler layer coupled to and immediately adjacent to said first surface layer and configured to flex from a first position during an impact, wherein said second layer substantially returns to the first position post impact; and a third layer for absorbing force coupled to the said first surface layer and said second layer.

2. The dynamic armor system according to claim 1, wherein said first surface comprises a plurality of independent segmented faces.

3. The dynamic armor system according to claim 1, further comprising a spall layer.

4. The dynamic armor system according to claim 1, further comprising an attachment system for coupling said dynamic armor system to a surface.

5. The dynamic armor system according to claim 1, wherein said impact comprises projectile impact.

6. The dynamic armor system according to claim 1, wherein said first surface layer is shaped to alter the trajectory of projectiles.

7. The dynamic armor system according to claim 1, wherein said second layer further comprises embedded shaped bodies to alter the trajectory of projectiles.

8. The dynamic armor system according to claim 1, wherein said second layer is configured to deform in response to a projectile strike.

9. The dynamic armor system according to claim 8, wherein said second layer is configured to reform post projectile strike.

10. A dynamic armor system, comprising:

a first surface layer forming an outward facing exterior to said dynamic armor system for reducing projectile velocity;

at least one dynamic layer coupled to and immediately adjacent to said first surface layer and configured to:

move from a first position during impact of a projectile; and substantially return to said first position post projectile impact; and at least one absorbing filler layer configured to absorb shock, wherein said absorbing filler layer is coupled to said first surface layer and said dynamic layer.

11. The dynamic armor system according to claim 10, wherein said dynamic layer comprises a plurality of independent segmented faces.

12. The dynamic armor system according to claim 10, further comprising a spall layer coupled to the at least one absorbing filler layer.

13. The dynamic armor system according to claim 10, further comprising a back strike plate coupled to the at least one absorbing filler layer.

14. The dynamic armor system according to claim 10, further comprising an attachment system for coupling said dynamic armor system to a second surface.

15. The dynamic armor system according to claim 10, wherein said absorbing fillet layer comprises embedded shaped bodies to alter the trajectory of projectiles.

16. The dynamic armor system according to claim 10, wherein said dynamic layer is configured to deform in response to a projectile strike.

17. A dynamic armor system according to claim 16, wherein said dynamic layer is configured to reform in response to the deformation following the projectile strike.

* * * * *